US005992495A

United States Patent [19]

Cadorette

[11] Patent Number: 5,992,495

[45] Date of Patent: Nov. 30, 1999

[54] CONCEALED-WAND CONTROL FOR A VERTICAL BLIND

[75] Inventor: Mario Cadorette, Saint Therese, Canada

[73] Assignee: All-Teck Blinds, P.T.B. Inc., Montreal

[21] Appl. No.: 09/053,767

[22] Filed: Apr. 2, 1998

[30] Foreign Application Priority Data

Dec. 9, 1997 [CA] Canada ..... 2224543

[51] Int. Cl.[6] ..... E06B 9/36

[52] U.S. Cl. ..... 160/168.1 V; 160/900; 160/176.1 V

[58] Field of Search ..... 160/178.1 V, 168.1 V, 160/176.1 V, 173 V, 177 V, 900

[56] References Cited

U.S. PATENT DOCUMENTS

| | | | |
|---|---|---|---|
| 558,372 | 4/1896 | Errington . | |
| 1,648,996 | 11/1927 | Reibel . | |
| 1,854,829 | 4/1932 | Doring et al. . | |
| 4,200,135 | 4/1980 | Hennequin . | |
| 4,267,875 | 5/1981 | Koks . | |
| 4,316,493 | 2/1982 | Arena . | |
| 4,456,049 | 6/1984 | Vecchiarelli . | |
| 4,621,672 | 11/1986 | Hsu . | |
| 4,799,527 | 1/1989 | Villoch et al. . | |
| 5,002,113 | 3/1991 | Georgopoulos . | |
| 5,038,843 | 8/1991 | Sommerfeld . | |
| 5,413,162 | 5/1995 | Ciriaci . | |
| 5,465,779 | 11/1995 | Rozon . | |
| 5,501,116 | 3/1996 | Weng . | |
| 5,575,323 | 11/1996 | Smuckler . | |
| 5,577,542 | 11/1996 | Hung | 160/177 V |
| 5,647,422 | 7/1997 | Weng | 160/176.1 V |
| 5,657,807 | 8/1997 | Hsu | 160/178.1 V |
| 5,671,794 | 9/1997 | Nien | 160/900 |
| 5,682,938 | 11/1997 | Hsu | 190/177 V |
| 5,749,406 | 5/1998 | Benthin . | |
| 5,771,953 | 6/1998 | Benthin | 160/900 |
| 5,848,632 | 12/1998 | Chou | 160/168.1 V |
| B1 4,316,493 | 6/1997 | Arena . | |

FOREIGN PATENT DOCUMENTS

| | | |
|---|---|---|
| 9229861 | 6/1993 | Australia . |
| 1244752 | 11/1988 | Canada . |

*Primary Examiner*—Blair M. Johnson
*Attorney, Agent, or Firm*—Sughrue, Mion, Zinn, Macpeak & Seas, PLLC

[57] ABSTRACT

A vertical blind having a head-rail, a plurality of carriers slidable in the head-rail for movement between open and closed positions. A respective vane is suspended from each of the carriers and a pivot rod is rotatably mounted in the head-rail and extending through the carriers for rotating the vanes. A control assembly comprises a controller securely affixed to a first carrier. The controller includes a control body slidably mounted in the head-rail, a first gear member disposed within the carrier body and rotationally coupled to the pivot rod and slidable thereon, and a control shaft rotatably mounted in the control body and extending through a base portion of the control body. The control shaft includes a second gear member operatively engaged with the first gear member, so that rotation of the control shaft causes rotation of the pivot rod via rotation of the second gear member and the first gear member. The control shaft further includes means for operatively coupling a wand to the control shaft, whereby the control shaft can be rotated by rotating the wand, and the control assembly can be slid within the head-rail by pulling the wand. The control shaft is mounted at an angle within the control body so that, when the vanes are rotated towards their closed position, the wand is concealed behind a vane suspended from the first carrier.

16 Claims, 10 Drawing Sheets

CONCEALED-WAND CONTROL FOR A VERTICAL BLIND

CROSS-REFERENCE TO RELATED APPLICATIONS

This application claims priority of Canadian Patent Application No. 2,224,543 filed Dec. 9, 1997.

SUMMARY OF THE INVENTION

This invention relates to a vertical blind control, and in particular to a control in which a concealed wand is used for both traversing and rotating the vanes of a vertical blind.

Vertical blinds have become increasingly popular over the past several years. Such blinds typically include a casing or head-rail containing tracks extending the length thereof for slidably supporting a plurality of vane carriers, a plurality of vanes suspended from the carriers, a pivot rod extending through the carriers permitting sliding or traversing of the vanes between open and closed positions at one or both ends of the head-rail, and a gearing system between the pivot rod and each carrier, whereby rotation of the rod causes a corresponding, simultaneous rotation or pivoting of the vanes. The carriers and vanes are usually moved between the open and closed positions using a loop of cord at one end of the blind. The cord is connected to the carrier at the other end of the blind, so that pulling on one side of the cord loop moves the vanes in one direction, and pulling on the other side of the loop moves the vanes in the opposite direction. During opening or closing, the carriers slide along the stationary pivot rod. In order to rotate or pivot the vanes, the pivot rod is rotated using a chain and a gear system on one end of the rod. Thus, two separate controls are required to effect traversing and pivoting of the vanes. The loops in the external ends of the cord and chain present a danger to small children.

Attempts have been made to provide a single control wand for actuating both the blind traversing and pivot mechanisms. One such attempt is described in U.S. Pat. No. 5,465,779, which issued to David Rozen on Nov. 14, 1995. The Rozen device includes a somewhat complicated wand structure, which would be expensive to mass-produce and relatively difficult to operate. Co-pending and commonly assigned U.S. patent application No. 08/851,717, the contents of which are hereby incorporated herein by reference, presents another solution, in which a single control wand is used for both traversing and pivoting operations. In the invention of U.S. patent application No. 08/851,717, the control wand extends from a control unit housed at one end of the head-rail. A disadvantage of this arrangement is that when the vanes are traversed to an open position, the control wand remains fixed at the end of the head-rail, which is unattractive in appearance.

An alternative arrangement is to form the control unit to be similar to a carrier, and then to affix the control unit to a first carrier of the blind. This allows the control wand to be used for both opening and traversing the blind. While inexpensive, this arrangement has the disadvantages that the control wand also tends to interfere with the closing of the vanes, which means that an undesirable amount of light can pass between the vanes of the blind, and the vanes tend to inadvertently traverse along the head-rail under the influence of breezes. The first of these problems can be overcome by spacing the control unit and the first carrier apart by a sufficient distance so that the vanes can be tightly closed without contacting the control wand. However, this limits the maximum extent to which the vanes can be traversed, so that an undesirably large gap will exist between the first vane and the window frame, thereby increasing the light-factor of the blind. Furthermore, in this arrangement, the control wand will be visible at all times, which is unattractive in appearance.

An object of the present invention is to provide a vertical blind control in which a single wand effects both vane traversing and vane rotation operations, using a control system which is simple in terms of both structure and operation.

Another object of the invention is to provide a vertical blind control in which the control wand can be concealed from view.

A further object of the invention is to provide a vertical blind control which allows the blind to be tightly closed to minimize the light factor of the blind.

A still further object of the invention is to provide a vertical blind control which is reversible, so that the head-rail can be installed in a window with the blind closing by traversing the vanes to either the left, or the right.

A still further object of the invention is to provide a vertical blind control which includes a latch mechanism for preventing inadvertent traversing of the vanes from the closed position of the blind.

Accordingly, an aspect of the present invention provides a vertical blind having a head-rail, a plurality of carriers slidable in the head-rail for movement between open and closed positions. A respective vane is suspended from each of the carriers and a pivot rod is rotatably mounted in the head-rail and extending through the carriers for rotating the vanes. A control assembly comprises a controller removably affixed to a first carrier. The controller includes a control body slidably mounted in the head-rail, a first gear member disposed within the control body and slidably disposed on the pivot rod and rotationally coupled thereon to prevent rotation of the pivot rod relative to the first gear, and a control shaft rotatably mounted in the control body and extending through a base portion of the control body. The control shaft includes a second gear member operatively engaged with the first gear member, so that rotation of the control shaft causes rotation of the pivot rod via rotation of the second gear member and the first gear member. The control shaft further includes means for operatively coupling a wand to the control shaft, whereby the control shaft can be rotated by rotating the wand, and the control assembly can be slid within the head-rail by pulling the wand. The control shaft is mounted at an angle within the control body so that, the wand can hang from the control shaft out of the plane of the vanes such that the vanes can be closed tightly, and when the vanes are rotated towards their closed position, the wand is concealed behind a vane suspended from the first carrier.

In an embodiment of the present invention, the control shaft is rotatably mounted in a collar, which is pivotably and slidably mounted in the control body between first and second positions. In the first position of the collar, the control shaft is securely retained at a first angle with respect to the vertical, whereby the wand will hang on a first side of the vanes. In the second position of the collar, the control shaft is securely retained at a second angle with respect to the vertical, whereby the wand will hang on a second side of the vanes. By this arrangement, a user can install the head-rail in a window frame so that the blind can be closed by traversing the vanes to either the left or right as desired by the user. The collar can then be selectively positioned within the control unit body so that the wand will hang from the control shaft between the plane of the vanes, and the window pane—such that the wand will be concealed behind the vanes when they are rotated to a closed or partially closed position.

An aspect of the invention includes a latch arm operatively disposed proximal one end of the head-rail, whereby the control assembly can be prevented from inadvertently sliding within the head-rail away from a closed position of the blind. Conveniently, the latch arm includes a support arm affixed to an endplate of the head-rail, and an engagement ramp and slider portion disposed on the end of the spring arm. A spring portion extends upwardly from the free end of the slider portion and abuts against an interior surface of the head-rail. By this means, the engagement ramp and slider portion can ride up onto the top portion of the control assembly, against the spring force of the spring portion, as the control assembly is moved towards the end of the head-rail. Friction between the slider portion and the control assembly acts to retain the control assembly in place against forces due to breezes or the like acting on the vanes of the blind.

BRIEF DESCRIPTION OF THE DRAWINGS

Further features and advantages of the present invention will become apparent from the following detailed description, taken in combination with the appended drawings, in which.

DETAILED DESCRIPTION

The following description relates to a single blind. However, the same system with modifications obvious to a person skilled in the art can be used for a double or split blind, i.e. a vertical blind with two sets of vanes for opening to each side of a window opening.

Figure 1:
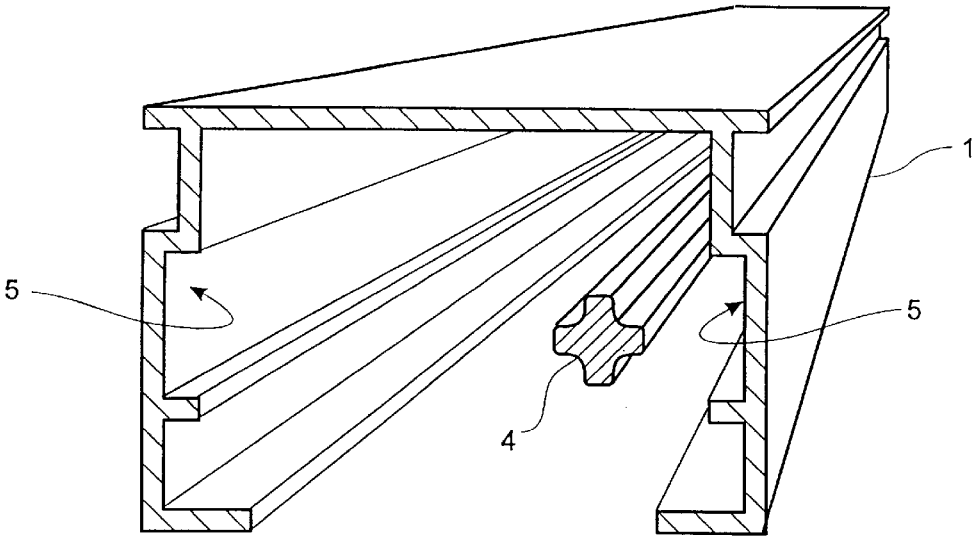
FIG. 1 is a perspective end view of a head-rail of the general type used in the present invention.
Figure 2:
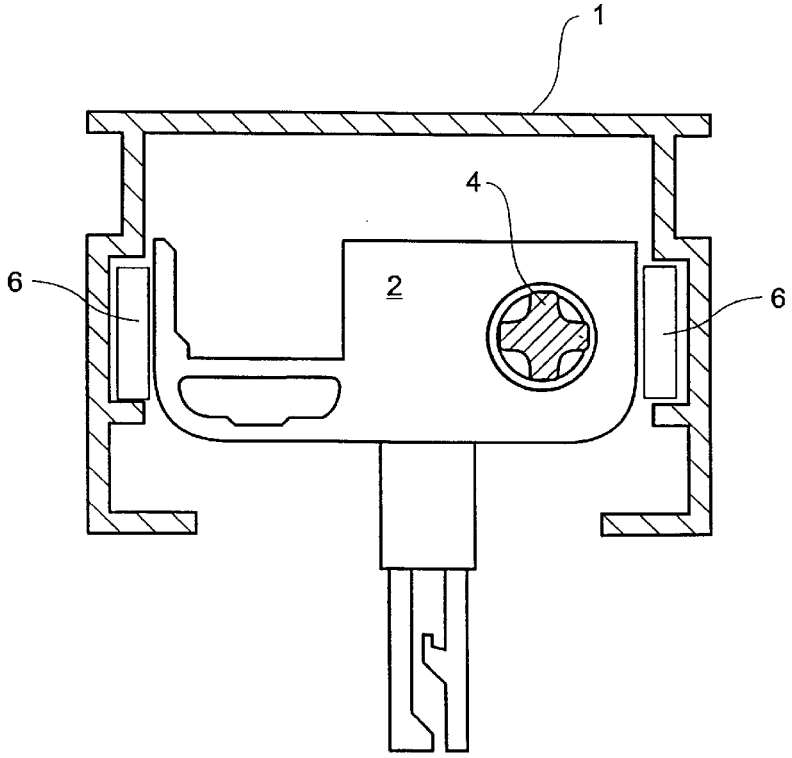
FIG. 2 is an end view of the head-rail of FIG. 1, illustrating a typical carrier mounted within the head-rail.
Figure 3:
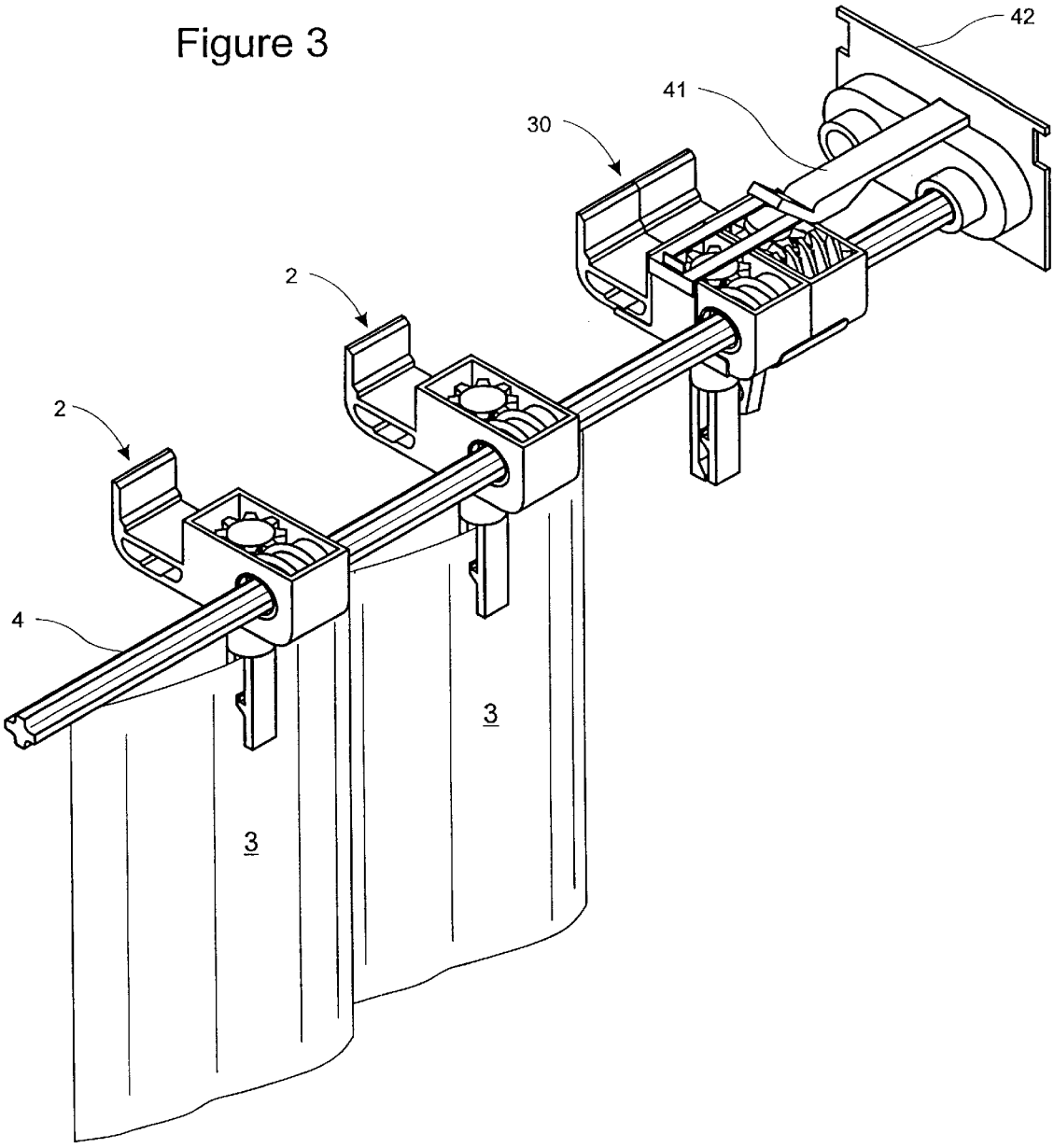
FIG. 3 is an isometric view of a pivot rod, carriers, and a control assembly in accordance with the present invention installed in the head-rail of FIGS. 1 and 2.

With reference to FIGS. 1 to 3, the control of the present invention is designed for use on a vertical blind of the type including an elongated, generally rectangular casing commonly referred to as a head-rail 1, within which a plurality of carriers 2 are slidably mounted. Each carrier 2 is capable of supporting a respective vane 3 of the blind. A pivot rod 4 extends longitudinally through the head-rail 1, and each of the carriers 2, so that all of the vanes 3 of the blind can be rotated between open and closed positions in unison by rotation of the pivot rod 4. The pivot rod 4 is generally formed as a shaft having one or more grooves extending along the length of the shaft. In the illustrated example, the pivot rod 4 includes four grooves, thereby giving a cruciform appearance to the cross-section of the pivot rod 4.

The head-rail 1 includes a pair of tracks 5 defined by cooperating surfaces formed in the interior of the head-rail, for supporting the carriers. Typically, each of the carriers 2 includes a pair of wheels 6 which run in the tracks 5, thereby facilitating sliding movement along the head-rail.

Figure 5:
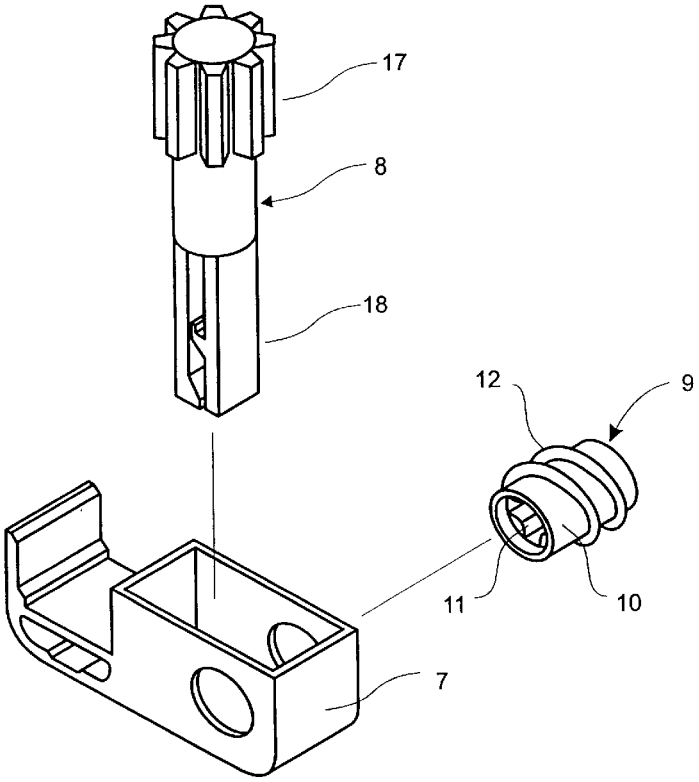
FIG. 5 is an exploded view showing the principal elements of the carrier of FIG. 4.
Figure 4:
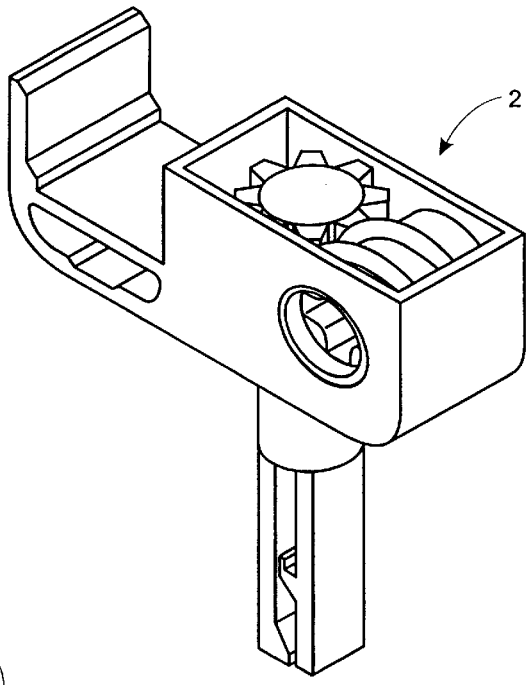
FIG. 4 is an isometric view of a carrier.
Figure 6:
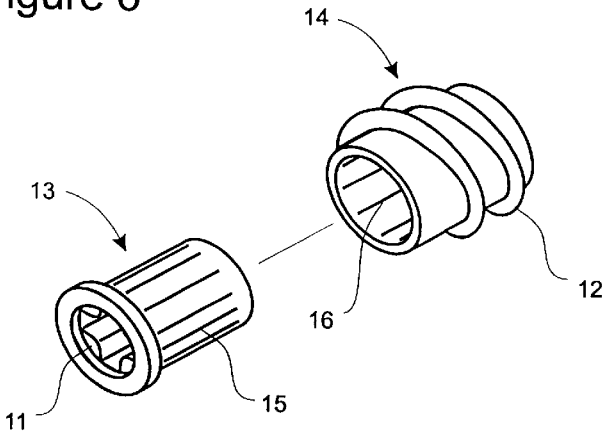
FIG. 6 is an exploded view of a second embodiment of a worm gear usable in the carrier of FIG. 4.

The carriers 2 are of generally conventional construction, and formed of a carrier body 7 within which is mounted a support arm 8, and a worm gear 9 (see FIGS. 4 and 5). The worm gear 9 is generally formed as a hollow cylinder 10 sized to slidingly fit over the pivot rod 4. The interior surface of the cylinder 10 includes at least one lug 11 (four are provided in the illustrated example) which protrudes into the interior of the cylinder 10 for engaging a corresponding groove of the pivot rod 4. A worm gear thread 12 is formed on the exterior surface of the hollow cylinder 10, and protrudes outwardly therefrom. The worm gear 9 can be conveniently formed as either a single unit, or as an assembly as illustrated in FIG. 6. In the latter case, the worm gear 9 is designed as co-axially inter-fitting inner 13 and outer cylinders 14. The interior surface of the inner cylinder 13 includes at least one lug 11 (four are provided in the illustrated example) which protrudes into the interior of the inner cylinder 13 for engaging a corresponding groove of the pivot rod 4. The exterior surface of the inner cylinder 13 includes a plurality of ridges 15 extending outwardly therefrom. Correspondingly, the interior surface of the outer cylinder 14 includes a plurality of ridges 16 extending toward the interior of the cylinder 14. A worm gear thread 12 is formed on the exterior surface of the outer cylinder 14, and protrudes outwardly therefrom. In use, the inner cylinder 13 is inserted into the outer cylinder 14, and the assembly inserted into the carrier body 7. Rotation of the pivot rod 4 causes a corresponding rotation of the inner cylinder 13, and this rotation is transmitted to the outer cylinder 14 through interference between the corresponding ridges 15, 16 on the exterior surface of the inner cylinder 13 and the interior surface of the outer cylinder 14. This arrangement has the advantage that the corresponding ridges of the inner and outer cylinders 13, 14 can ride over one another, so that continued rotation of the pivot rod 4 will not cause damage to the carrier 2 if the support arm 8 or vane 3 become jammed.

The upper portion of the support arm 8 includes a spur gear 17 which operatively engages the worm gear 9, so that rotation of the worm gear 9 causes a corresponding rotation of the support arm 8. The lower portion of the support arm 8 includes a clip 18 for supporting a respective vane 3 of the blind. By sliding the carriers 2 along the tracks 5, the vanes 3 are traversed, i.e. the blind is opened or closed. The vanes 3 are caused to move in unison using conventional stringers (not shown) interconnecting the carrier bodies 7. The stringers act to limit the maximum separation between adjacent carriers 2, while allowing adjacent carriers 2 to approach each other closely. By this means, it is necessary only to directly control the traversing of a first carrier 2*a* in order to effect the traversing of all of the carriers 2 between open and closed positions of the blind.

The vanes 3 can be pivoted in unison about their longitudinal axes between positions in which they all lie in a plane substantially parallel to the longitudinal axis of the head-rail 1, and positions in which the vanes 3 are inclined with respect to or perpendicular to the longitudinal axis of the head-rail 1.

Figure 8:
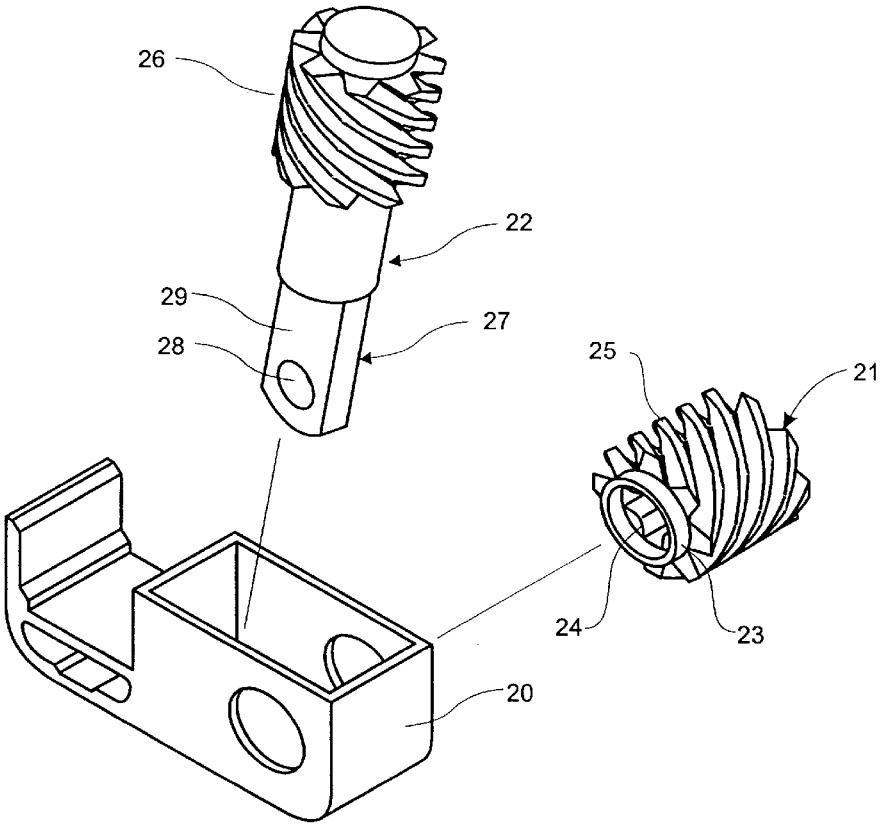
FIG. 8 is an exploded view showing the principle elements of the controller of FIG. 7.
Figure 7:
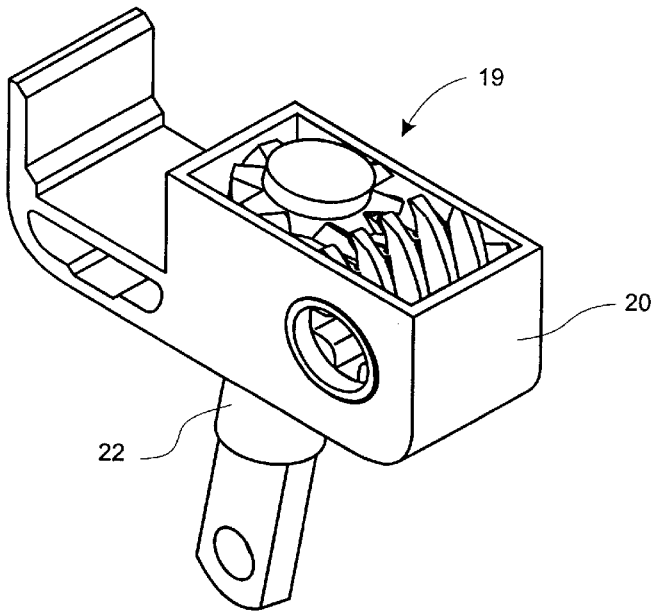
FIG. 7 is an isometric view of a controller in accordance with an embodiment of the present invention.

Referring now to FIGS. 7 and 8, the controller 19 comprises a control body 20, a helical gear 21, and a control shaft 22. The control body 20 has generally the same overall dimensions, and is similar in shape to the carrier body 7, so that the controller 19 can be inserted into the head-rail 1 and can be slid along the head-rail 1. As with the worm gear 9 of the carriers 2, the helical gear 21 is generally formed as a hollow cylinder 23 sized to slidingly fit over the pivot rod 4. The interior surface of the cylinder 23 includes at least one lug 24 which protrudes into the interior of the cylinder 23 for engaging a corresponding groove of the pivot rod 4, whereby the pivot rod 4 can be caused to rotate by rotation of the helical gear 21. A plurality of helical gear teeth 25 are formed on the exterior surface of the hollow cylinder 23, and protrude outwardly therefrom. The upper portion of the control shaft 22 includes an helical gear 26 which operatively engages the helical gear 21, so that rotation of the control shaft 22 causes a corresponding rotation of the helical gear 21, and thereby also the pivot rod 4. The lower portion of the control shaft 22 includes a connection means 27 for engaging an end of a control wand (not shown). In the illustrated embodiment, the connection means 27 comprises a hole 28 proximal the end of a flattened portion 29 of the control shaft 22. By this means, a hooked end of a conventional rod-type control wand can be inserted through the hole 28 in the control shaft 22, whereupon the wand can be rotated to rotate the control shaft 22, or pulled parallel to the longitudinal axis of the head-rail 1 to traverse the controller 19 along the length of the head-rail 1.

Figure 10:
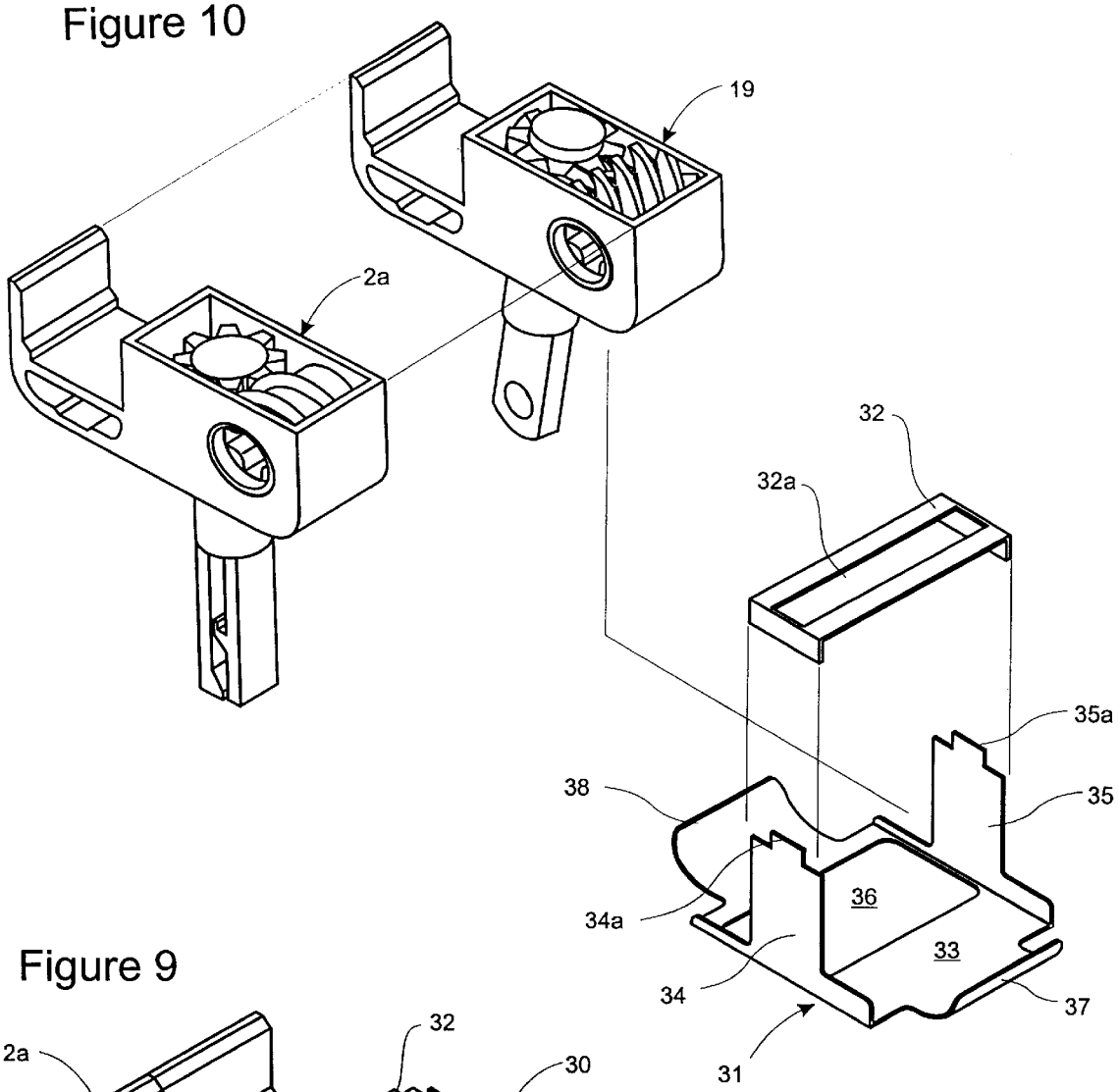
FIG. 10 is an exploded view showing the principle elements of the control assembly of FIG. 9.

Referring to FIGS. 3, and 9–11, a control assembly 30 is formed by securing the controller 19 to a first carrier 2*a*, so that opening and closing of the blind can be accomplished by traversing the control assembly 30 along the length of the head-rail 1. Conveniently, the controller 19 is secured to the first carrier 2*a* by means of a clip 31 and cover 32 assembly. As shown in FIG. 10, the clip 31 generally comprises a base-plate 33, and two opposed upright portions 34, 35 extending from the base-plate 33. The base-plate 33 includes an opening 36 which allows the ends of the control shaft 22 of the controller 19 and the support arm 8 of the carrier 2*a* to extend below the base plate 33. The width of the base plate 33 (i.e. the dimension between the opposed upright portions 34, 35) is approximately equal to the combined width of the carrier 2*a* and controller 19. Finally, the base-plate 33 includes a pair of opposed upturned portions 37, 38 which generally conform to the shape of the carrier 2*a* and controller 19.

The up-right portions 34, 35 of the clip 31 are generally sized to correspond the dimensions of the carrier 2*a* and controller 19, and to prevent interference between the clip 31 and either the pivot rod 4 or stringers. A respective tab 34*a*, 35*a* extends above the top of each of the up-right portions 34,35, for engagement with the cover 32.

Figure 9:
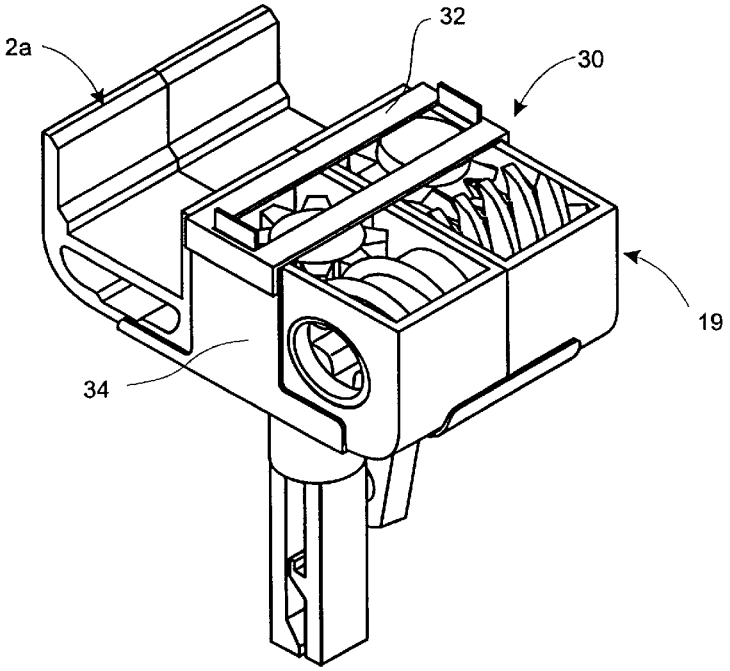
FIG. 9 is an isometric view of a control assembly utilizing the carrier of FIG. 4 and the controller of FIG. 7.

The cover 32 is designed to extend between the up-right portions 34, 35 of the clip 32, over the tops of the carrier 2*a*, controller 19, and the upright portions 34, 35 of the clip as shown in FIGS. 9 and 10. In this condition, the tabs 34*a*, 35*a* can be inserted through an opening 32*a* in the cover 32 and bent outwards to lock the cover 32 in place, and thereby prevent the carrier 2*a* and controller 19 from falling out of the clip 31 and separating from each other.

Figure 11:
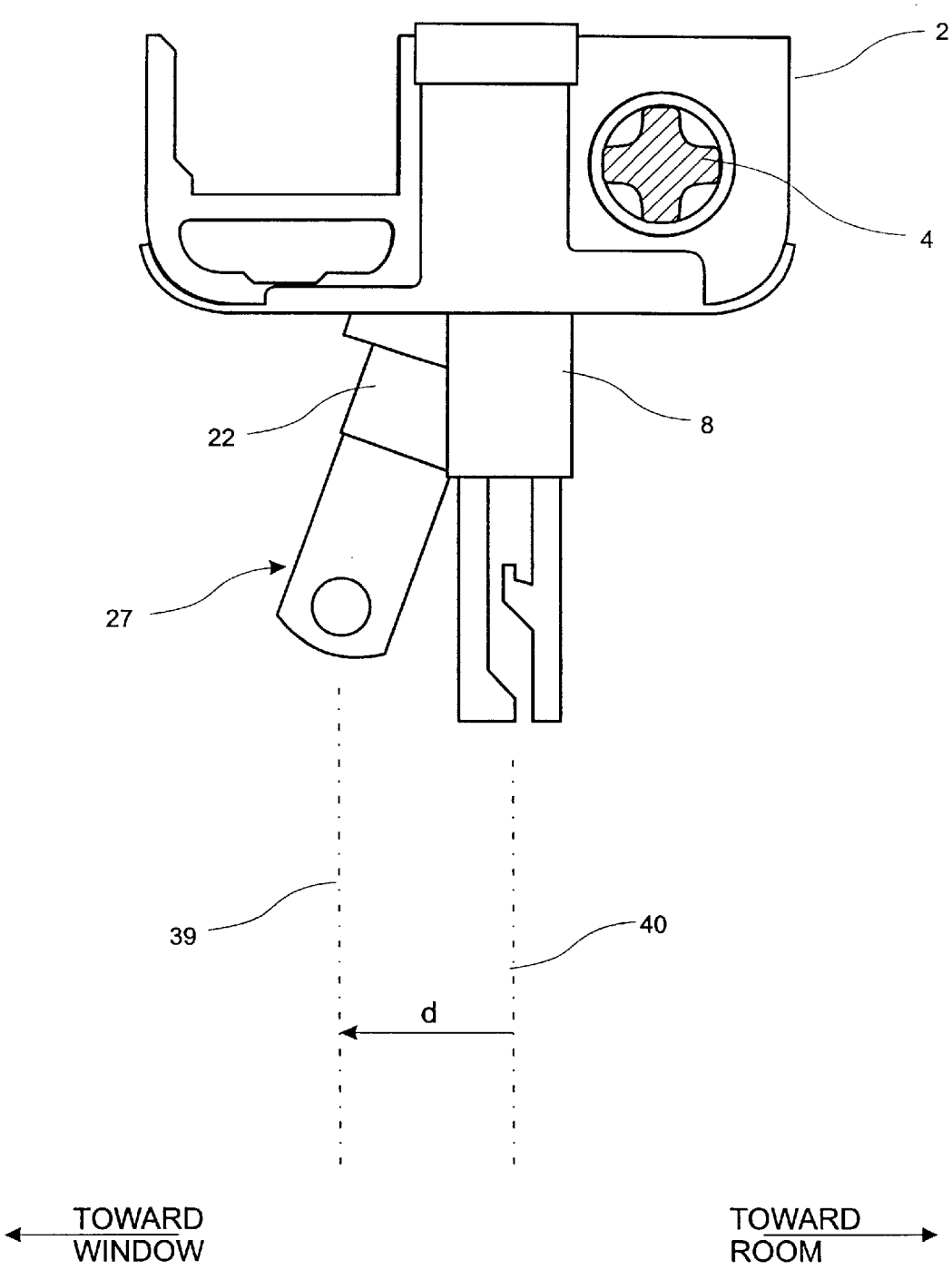
FIG. 11 is a side view of an assembled control assembly.

Referring now to FIG. 11, it will be seen that the control shaft 22 of the controller 19 is mounted at an angle within the control body 20. As a result, the central axis 39 of a control wand (not shown) hanging from the connection means 27 will be separated by a distance d from the plane 40 of the vanes 3 when they are rotated to their closed positions. In this condition, the hanging control wand will not interfere with the vanes 3, so the vanes 3 can be closed tightly to thereby minimize the amount of light which can pass through the closed blind. Furthermore, when the blind is mounted in such a manner that the control shaft 22 projects towards a window, then, as viewed from within an adjoining room, the hanging control wand will be concealed behind the vane 3 suspended from the first carrier 2*a*. As a consequence, the control wand can be concealed from view, at any point along the length of the blind, simply by rotating the vanes 3 toward the closed position. This arrangement significantly improves the appearance of the blind, particularly when the vanes have been traversed to an opened or partially opened condition.

Figure 12:
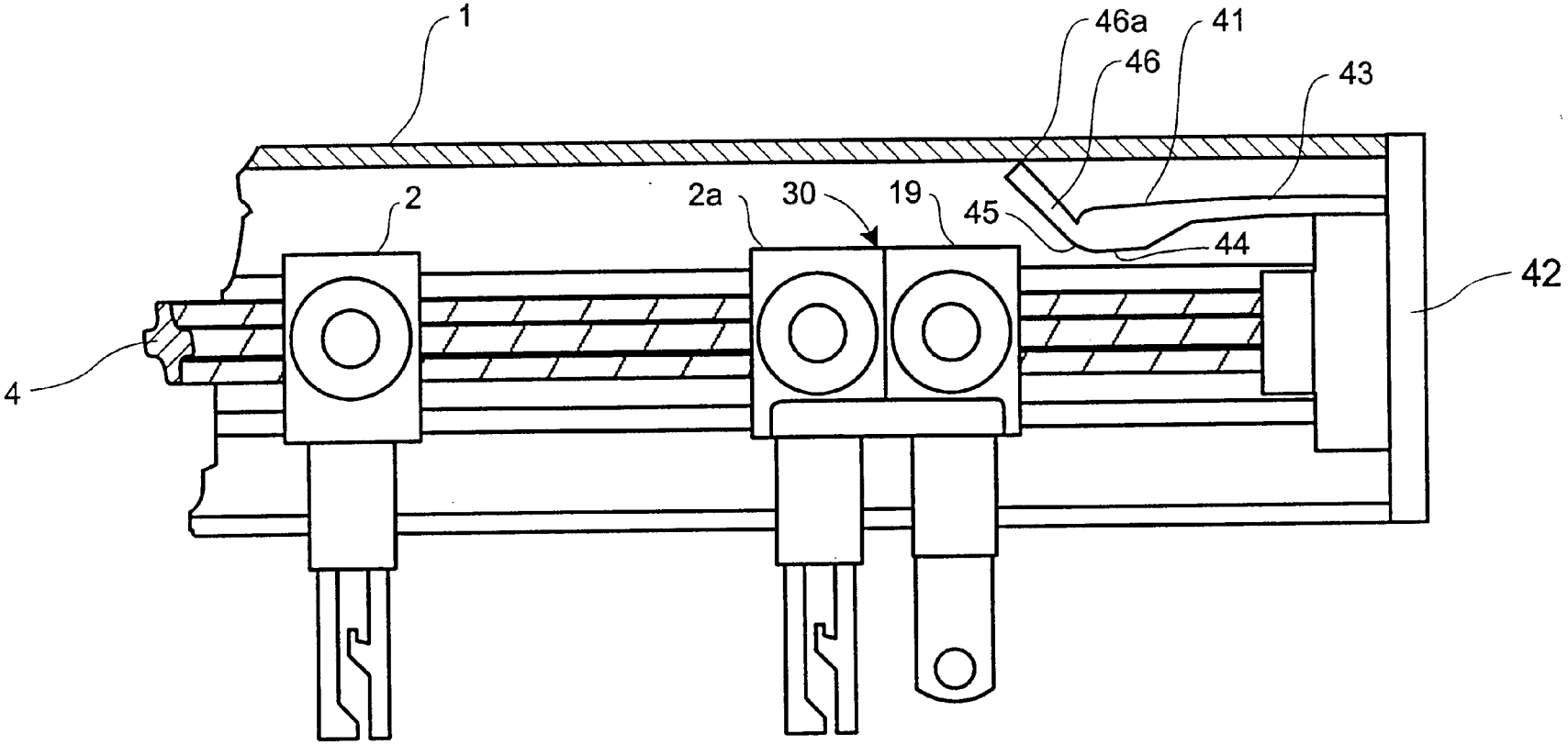
FIG. 12 is partial cross-sectional view of an assembled head-rail, showing the control assembly of FIG. 9 approaching an end of the head-rail.
Figure 13:
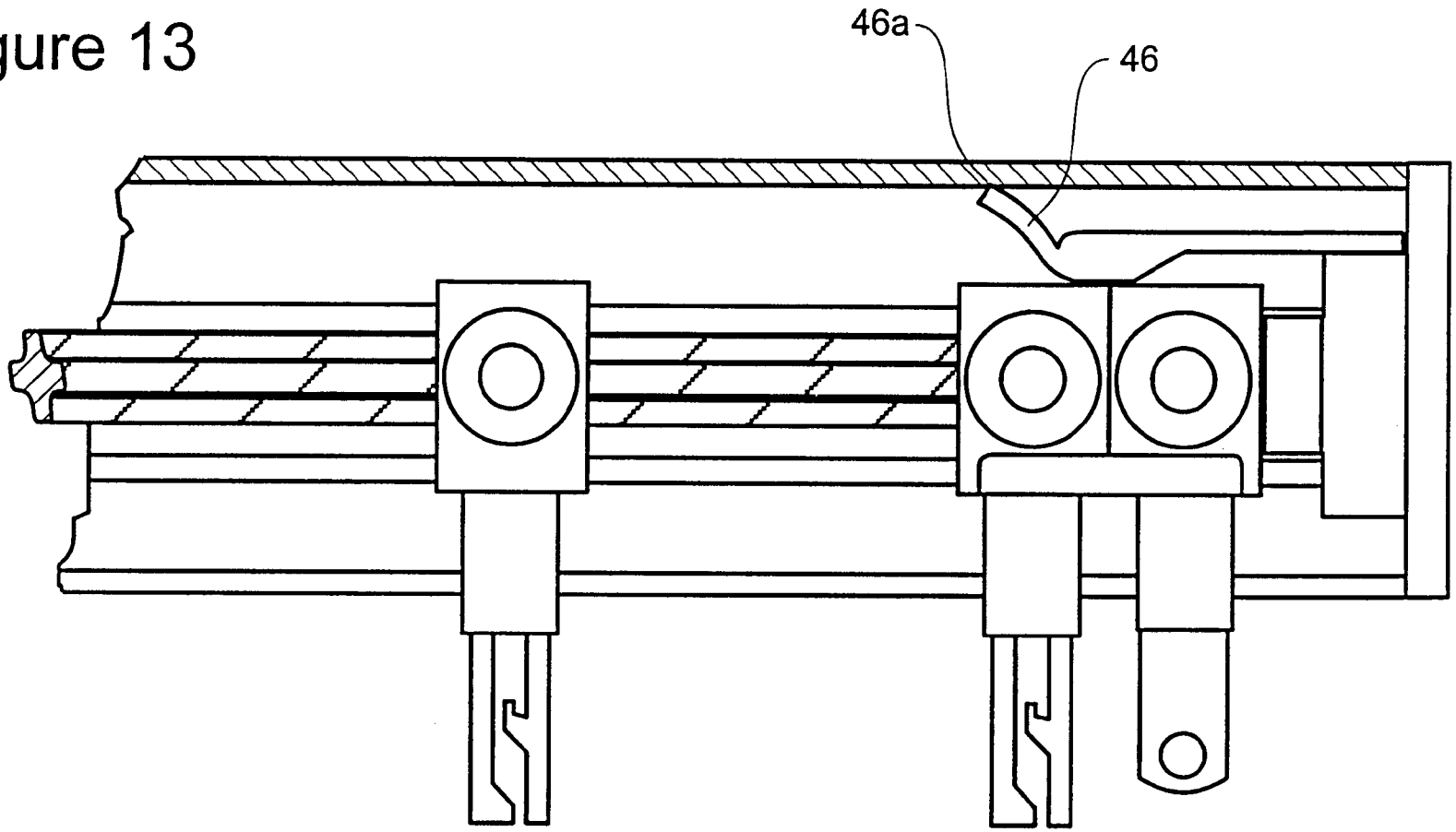
FIG. 13 is partial cross-sectional view of an assembled head-rail, showing the control assembly of FIG. 9 secured at an end of the head-rail by the latch arm.
Figure 15:
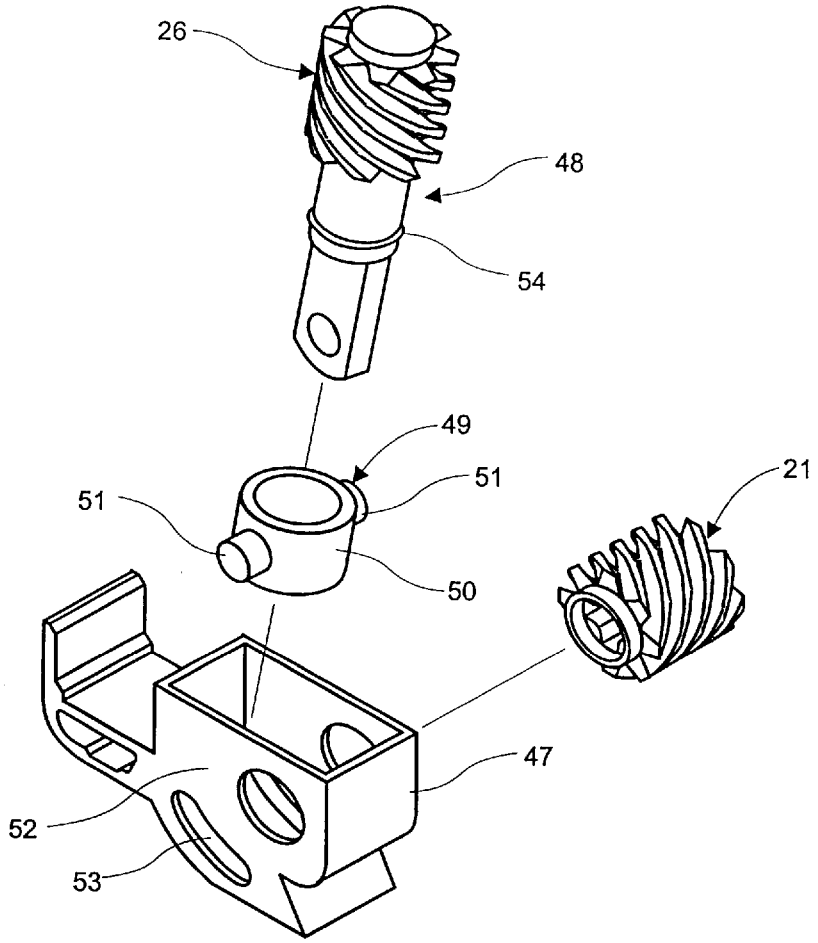
FIG. 15 is an exploded view showing the principle elements of the controller of FIG. 14.
Figure 14:
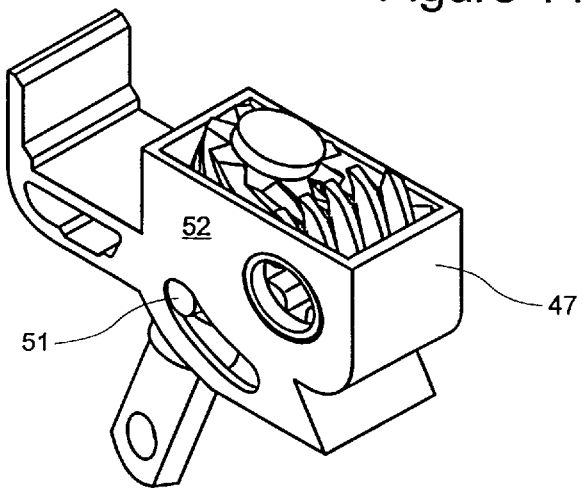
FIG. 14 is an isometric view of a second embodiment of a controller in accordance with the present invention.
Figure 16:
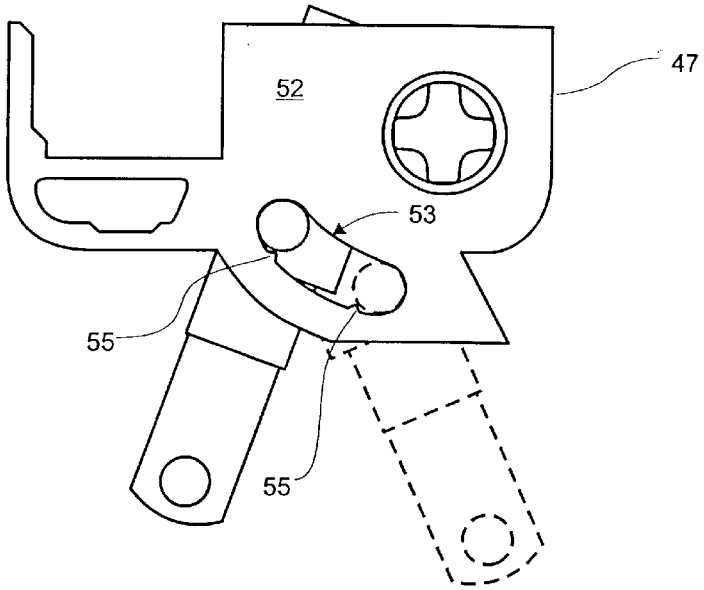
FIG. 16 is a side view of the controller of FIG. 14.
Figure 17:
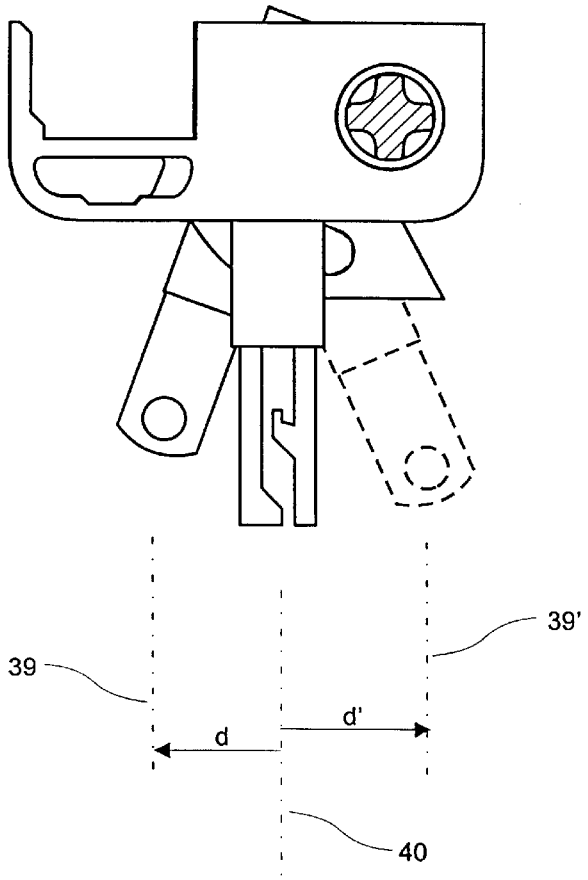
FIG. 17 is a side view of a control assembly utilizing the controller of FIG. 14.

Referring to FIGS. 3, 12 and 13, a latch arm 41 is provided on an end-plate 42 of the head-rail 1, so that the control assembly 30 can be locked in the closed position of the blind. As best illustrated in FIGS. 12 and 13, the latch arm 41 comprises a support member 43 affixed to the end plate 42, and extending roughly parallel to the longitudinal axis of the head-rail 1. A slider portion 44, and an engagement ramp 45 are provided on the free end of the support member 43, to facilitate engagement of the control assembly 30 with the latch arm 41. A spring portion 46 extends upwardly from the slider portion 44 to provide a continuation of the engagement ramp 45. An upper edge 46*a* of the spring portion 46 bears against an interior surface of the head-rail so that the spring portion can flex and force the slider portion of the latch arm 41 downwards. In use, the control assembly 30 is drawn toward the end of the head-rail 1, pulling the other carriers 2 along with it to close the blind. As the control assembly 30 approaches the end plate 42, the advancing face of the control assembly 30 contacts the engagement ramp 45 of the latch arm 41. Continued motion of the control assembly 30 causes the engagement ramp 45 and the slider portion 44 to ride up and onto the upper surface of the control assembly 30, against the spring force of the spring portion 46 which forces the slider portion 44 downwards against the top of the control assembly. Under this condition, friction between the latch arm 41 and the control assembly 30 prevents the control assembly 30 from inadvertently drifting back toward the other end of the head-rail 1. Thus by means of the latch arm 41, the blind can be closed, and will be positively retained in the closed position.

Referring now to FIGS. 14 to 17, a second embodiment of the controller will now be described in detail. This second controller is characterized by the feature that that the control shaft can be pivoted and locked in two different positions. In a first position, the control shaft is angled so that a wand will hang on one side of the plane 40 of the vanes 3. Conversely, when the control shaft is pivoted to is other position, the control shaft is angled so that a wand will hang on the opposite side of the plane 40 of the vanes 3. Thus the controller is reversible, in the sense that the control shaft can be adjusted so that the control wand will hang on either side of the plane of the vanes 3. This arrangement has the advantage, that a user can install the head-rail so that the blind will open by traversing the vanes to either the right of the left. The control shaft can then be adjusted so that the control wand will hang between the vanes and the window, so that the wand will be concealed from view when the vanes are pivoted toward the closed position.

As with the controller 19 described above, the reversible controller comprises a control body 47, a helical gear 21, a control shaft 48 and a collar 49. The helical gear 21 is identical to that described above, and thus will not be described in further detail here. The collar 49 is formed as a hollow cylinder 50 sized to slide over the control shaft 48 and freely rotate thereon. A pair of opposed mounting lugs 51 extend outwardly from the hollow cylinder 50 of the collar 49 for mounting the collar 49, and thus the control shaft 48 within the control body 47. The control body 47 is generally similar to the control body 20, in that it is dimensioned so that it can be inserted into the head-rail 1 and can be slid along the head-rail 1. However, in this case the side walls 52 of the control body 47 extend downwardly and include a respective groove 53 for slidably and pivotably receiving the mounting lugs 51 of the collar 49. The control shaft 48 is generally similar to the control shaft 22, except that it includes a retainer means 54 for rotatably locking the collar 49 onto the control shaft 48. The retainer means 54 can conveniently be formed as a circumferential ridge around the control shaft 48. In this case, the collar 49 can be slid over the end of the control shaft 48 and forced over the circumferential ridge until it rests between the helical gear 26 and the retainer ring. Thus the collar 49 will be free to rotate about the control shaft 48, but will be prevented from sliding longitudinally along the control shaft 48 by the helical gear 26 and the retainer ring. Alternatively, the retainer means 54 could be provided by one or more lugs (not shown) formed on the control shaft 48, or an o-ring or split washer (not shown) which can be installed into a suitable groove (not shown) on the control shaft 48 after installation of the collar 49. Using any of these arrangements, the control shaft 48/collar 49 assembly can then be installed into the control body 47 so that the mounting lugs 51 of the collar 49 can slide within respective grooves 53 of the side walls 52 of the control body 47.

In order to positively retain the control shaft 48 in one of its two positions, a locking means is conveniently provided. Conveniently, the locking means can be provided as a pair of stop lugs 55 disposed in the grooves 53 of the side walls 52 of the control body 47. By means of the stop lugs, the mounting lugs 51 of the collar 49 can be "snapped" into position at either end of the grooves 53, thereby securing the control shaft 48 in position.

It will be clear to those skilled in the art that the above described embodiment can be varied without departing from the scope of the present invention. Thus it will be apparent that the above description is illustrative rather than limitative of the invention defined in the appended claims.

What is claimed is:

1. In a vertical blind having a head-rail, a plurality of carriers slidable in the head-rail for movement between open and closed positions of the blind, a respective vane suspended from each of the carriers, and a pivot rod rotatably mounted in the head-rail and extending through the carriers for rotating the vanes, the improvement comprising:

a control assembly comprising a controller removably affixed to a first carrier, the controller comprising:

(a) a control body slidably mounted in the head-rail, the control body having overall dimensions and shape approximately equal to those of a carrier body of each carrier;

(b) a first gear disposed within the control body and slidably disposed on the pivot rod, the first gear being rotationally coupled to the pivot rod to prevent rotation of the pivot rod relative to the first gear;

(c) a control shaft rotatably mounted in the control body and extending through a base portion of the control body (d) a second gear fixedly disposed on an upper portion of the control shaft and directly with the first gear, so that rotation of the control shaft causes rotation of the pivot rod via rotation of the second gear and the first gear; and (e) coupling means capable of operatively coupling a wand to the control shaft, whereby a user can cause rotation of the control shaft by rotating the wand, and a user can slide the control assembly within the head-rail by pulling the wand;

wherein the control shaft is mounted at an angle within the control body such that a wand suspended from the coupling means will hang out of the plane of the vanes.

2. A vertical blind as defined in claim 1, wherein the angle of the control shaft is selected so that, when the vertical blind is mounted in association with a window of a room, a wand suspended from the coupling means will hang between a vane suspended from the first carrier and the window, whereby, as viewed from within the room, the wand will be concealed from view when the vanes are rotated to a partially closed position.

3. A vertical blind as defined in claim 1, further comprising adjusting means for adjusting the angle of the control shaft between a first angle in which a wand suspended from the coupling means will hang on one side of the plane of the vanes, and a second angle in which a wand suspended from the coupling means will hang on the opposite side of the plane of the vanes.

4. In a vertical blind having a head-rail, a plurality of carriers slidable in the head-rail for movement between open and closed positions of the blind, a respective vane suspended from each of the carriers, and a pivot rod rotatably mounted in the head-rail and extending through the carriers for rotating the vanes, the improvement comprising:

a control assembly comprising a controller removably affixed to a first carrier, the controller comprising:

(a) a control body slidably mounted in the head-rail:

(b) a first gear member disposed within the control body and rotationally coupled to the pivot rod and slidable thereon:

(c) a control shaft rotatably mounted in the control body and extending through a base portion of the control body;

(d) a second gear member fixedly disposed on an upper portion of the control shaft and operatively engaged with the first gear member, so that rotation of the control shaft causes rotation of the pivot rod via rotation of the second gear member and the first gear member;

(e) coupling means capable of operatively coupling a wand to the control shaft, whereby a user can cause rotation of the control shaft by rotating the wand, and a user can slide the control assembly within the head-rail by pulling the wand, wherein the control shaft is mounted at an angle within the control body such that a wand suspended from the coupling means will hang out of the plane of the vanes; and adjusting means for adjusting the angle of the control shaft between a first angle in which a wand suspended from the coupling means will hang on one side of the plane of the vanes, and a second angle in which a wand suspended from the coupling means will hang on the opposite side of the plane of the vanes, wherein the adjusting means comprises a collar operatively disposed within the control body, the control shaft being pivotably supported within the collar; a pair of opposed studs extending outwardly from the collar; and a pair of opposed grooves disposed in respective opposite walls of the control body; the studs of the collar being slidably engaged within respective ones of the grooves, such that the angular position of the control shaft and collar can be adjusted while maintaining continuous operative engagement between the first and second gear members.

5. A vertical blind as defined in claim 1, wherein the controller is operatively secured to the first carrier by a clip and cover assembly.

6. In a vertical blind having a head-rail, a plurality of carriers slidable in the head-rail for movement between open and closed positions of the blind, a respective vane suspended from each of the carriers, and a pivot rod rotatably mounted in the head-rail and extending through the carriers for rotating the vanes, the improvement comprising:

a control assembly comprising a controller removably affixed to a first carrier, the controller comprising:

(a) a control body slidably mounted in the head-rail;

(b) a first gear member disposed within the control body and rotationally coupled to the pivot rod and slidable thereon;

(c) a control shaft rotatable mounted in the control body and extending through a base portion of the control body;

(d) a second gear member fixedly disposed on an upper portion of the control shaft and operatively engaged with the first gear member, so that rotation of the control shaft causes rotation of the pivot rod via rotation of the second gear member and the first gear member; and (e) coupling means capable of operatively coupling a wand to the control shaft, whereby a user can cause rotation of the control shaft by rotating the wand, and a user can slide the control assembly within the head-rail by pulling the wand, wherein the control shaft is mounted at an angle within the control body such that a wand suspended from the coupling means will hang out of the plane of the vanes, and wherein the controller is operatively secured to the first carrier by a clip and cover assembly, and wherein the clip comprises a base-plate and two opposed up-right portions disposed on opposite edges of the base-plate, a width of the base-plate, between the two up-right portions being substantially equal to a combined width of the controller, and the first carrier, and a height of the two up-right portions being substantially equal to a height of the controller.

7. A vertical blind as defined in claim 6, wherein the base-plate includes at least one opening sized to permit the control shaft of the controller and the support arm of the carrier to extend through the base-plate.

8. A vertical blind as defined in claim 6, wherein each of the upright portions of the clip includes a respective tab portion extending above the end of the up-right portion, and the cover includes at least one opening for receiving the tabs, whereby the tabs can be inserted through the cover and then bent over to lock the cover onto the clip, thereby preventing the controller and the first carrier from falling out of the clip and separating from each other.

9. In a vertical blind having a head-rail, a plurality of carriers slidable in the head-rail for movement between open and closed positions of the blind, a respective vane suspended from each of the carriers, and a pivot rod rotatably mounted in the head-rail and extending through the carriers for rotating the vanes, the improvement comprising:

a control assembly comprising a controller removably affixed to a first carrier, the controller comprising:

(a) a control body slidably mounted in the head-rail;

(b) a first gear member disposed within the control body and rotationally coupled to the pivot rod and slidable thereon;

(c) a control shaft rotatably mounted in the control body and extending through a base portion of the control body;

(d) a second gear member fixedly disposed on an upper portion of the control shaft and operatively engaged with the first gear member, so that rotation of the control shaft causes rotation of the pivot rod via rotation of the second gear member and the first gear member;

(e) coupling means capable of operatively coupling a wand to the control shaft, whereby a user can cause rotation of the control shaft by rotating the wand, and a user can slide the control assembly within the head-rail by pulling the wand, wherein the control shaft is mounted at an angle within the control body such that a wand suspended from the coupling means will hang out of the plane of the vanes; and a latch arm operatively disposed proximal an end of the head-rail, whereby the control assembly can be prevented from inadvertently sliding within the head-rail away from a closed position of the blind.

10. A vertical blind as defined in claim 9, wherein the latch arm includes a support arm affixed to an endplate of the head-rail, a slider portion disposed on a free end of the support arm, a front end of the slider portion including an angled surface defining an engagement ramp, whereby the engagement ramp and slider portion can ride up onto a top portion of the control assembly as the control assembly is moved towards the end of the head-rail.

11. A vertical blind as defined in claim 10, wherein the angled surface of the engagement ramp extends upward to define a spring portion depending from the forward end of the slider portion and operatively abutting an inner surface of the head-rail.

12. A vertical blind as defined in claim 11, wherein the spring portion is caused to resiliently bend as the engagement ramp and slider portion ride onto the top portion of the control assembly, whereby friction between the slider portion and the control assembly is increased by the resilient force of the spring portion.

13. In a vertical blind having a head-rail, a plurality of carriers slidable in the head-rail for movement between open and closed positions of the blind, a respective vane suspended from each of the carriers, a pivot rod rotatably mounted in the head-rail and extending through the carriers for rotating the vanes and a control assembly operatively affixed to a first carrier for selectively controlling traversing of carriers along the head-rail and rotation of the pivot rod, the improvement comprising:

a latch arm operatively disposed proximal an end of the head-rail, whereby the control assembly can be prevented from inadvertently sliding within the head-rail away from a closed position of the blind.

14. A vertical blind as defined in claim 13, wherein the latch arm includes a support arm affixed to an endplate of the head-rail, a slider portion disposed on a free end of the support arm, a front end of the slider portion including an angled surface defining an engagement ramp, whereby the engagement ramp and slider portion can ride up onto a top portion of the control assembly as the control assembly is moved towards the end of the head-rail.

15. A vertical blind as defined in claim 14, wherein the angled surface of the engagement ramp extends upward to define a spring portion depending from the forward end of the slider portion and operatively abutting an inner surface of the head-rail.

16. A vertical blind as defined in claim 15, wherein the spring portion is caused to resiliently bend as the as the engagement ramp and slider portion ride onto the top portion of the control assembly, whereby friction between the slider portion and the control assembly is increased by the resilient force of the spring portion.

* * * * *